US007192094B2

(12) United States Patent
Kelm

(10) Patent No.: US 7,192,094 B2
(45) Date of Patent: Mar. 20, 2007

(54) AUGER FLIGHT SUPPORT SYSTEM

(76) Inventor: Warren Kelm, 38 Shoshone Trail, Malvern, OH (US) 44644

( * ) Notice: Subject to any disclaimer, the term of this patent is extended or adjusted under 35 U.S.C. 154(b) by 0 days.

(21) Appl. No.: 11/433,238

(22) Filed: May 12, 2006

(65) Prior Publication Data

US 2006/0202547 A1 Sep. 14, 2006

Related U.S. Application Data

(63) Continuation of application No. 10/641,703, filed on Aug. 15, 2003, now abandoned, which is a continuation-in-part of application No. 10/074,412, filed on Feb. 12, 2002, now Pat. No. 6,679,559.

(51) Int. Cl.
*E21C 27/22* (2006.01)
*E21B 10/44* (2006.01)

(52) U.S. Cl. ..... 299/56; 299/55; 299/57; 175/323; 175/325.3; 175/91; 175/394; 198/666; 198/672

(58) Field of Classification Search ..... 299/55–56, 299/87.1; 175/91, 323, 325.2, 325.3, 394; 198/666, 672
See application file for complete search history.

(56) References Cited

U.S. PATENT DOCUMENTS

| | | | |
|---|---|---|---|
| 693,801 | A | 2/1902 | Leaverton |
| 1,088,748 | A | 2/1914 | Braasch |
| 1,729,211 | A | 9/1929 | Erisman |
| 2,298,332 | A | 10/1942 | Applegate |
| 2,709,572 | A | 5/1955 | Ageborn |
| 2,751,203 | A | 6/1956 | Compton |
| 2,783,974 | A | 3/1957 | Veasman |
| 2,839,271 | A | 6/1958 | Kandle |
| RE24,503 | E | 7/1958 | Compton |
| 2,887,300 | A | 5/1959 | Meredith |
| 2,940,740 | A | 6/1960 | Adams |
| 3,012,371 | A | 12/1961 | Pawela |
| 3,036,821 | A | 5/1962 | Letts |
| 3,083,955 | A | 4/1963 | Compton |
| 3,191,753 | A | 6/1965 | Kirkpatrick |

(Continued)

OTHER PUBLICATIONS

Coal Mining & Processing, Oct. 1975, 4 pages.

(Continued)

*Primary Examiner*—David Bagnell
*Assistant Examiner*—Shane Bomar
(74) *Attorney, Agent, or Firm*—Sand & Sebolt

(57) ABSTRACT

An auger support assembly for use with an augering system for mining which bores a pair of side-by-side holes through a coal seam using dual side-by-side augers. Each auger includes a drilling section which is followed by a series of auger flights for conveying the bored coal back out of the respective hole. The augers are connected together in axially aligned pairs and are supported by the auger support assembly. The auger support assembly includes a pair of bearing housings that are disposed on drive shafts which extend outwardly from the first ends of a first pair of parallel augers and are received within the second ends of a second pair of parallel augers. The bearing housings are connected to each other by a tie bar. A single support leg extends downwardly from approximately the mid-section of the tie bar to engage the ground ledge that is formed between the counter rotating augers.

20 Claims, 4 Drawing Sheets

U.S. PATENT DOCUMENTS

| | | | |
|---|---|---|---|
| 3,278,001 | A | 10/1966 | Andrews |
| 3,319,771 | A | 5/1967 | Nesseth |
| 3,327,840 | A | 6/1967 | Wilkes |
| 3,798,448 | A | 3/1974 | Ringkamp |
| 3,830,318 | A | 8/1974 | Busby |
| 3,856,357 | A | 12/1974 | Wharton |
| 3,912,025 | A | 10/1975 | Deeter et al. |
| 3,980,342 | A | 9/1976 | Dunham |
| 3,987,561 | A | 10/1976 | Gee et al. |
| 4,015,674 | A | 4/1977 | Hawthorne et al. |
| 4,036,529 | A | 7/1977 | Hawthorne et al. |
| 4,074,778 | A | 2/1978 | Morrell et al. |
| 4,159,149 | A | 6/1979 | Castanoli et al. |
| 4,220,242 | A | 9/1980 | Forsberg |
| 4,364,469 | A | 12/1982 | Rudolph |
| 4,440,539 | A | 4/1984 | Sullivan |
| 5,087,101 | A | 2/1992 | Justice et al. |
| 5,318,444 | A | 6/1994 | Kuzub et al. |
| 5,358,062 | A | 10/1994 | Uhl et al. |
| 5,496,095 | A | 3/1996 | Scholl |
| 5,685,382 | A | 11/1997 | Deeter |
| 6,206,177 | B1 | 3/2001 | Broten |
| 6,679,559 | B2 | 1/2004 | Kelm |

OTHER PUBLICATIONS

Heavy-Duty Elevating Conveyors , Undated Advertising Brochure, Bulletin No. CO-101K, 2 pages.

Salem Model 1020-36-DK Coal Recover Auger, Undated Advertising Brochure, Bulletin No. CA-102K, 2 pages.

The Salem MCK Coal Recovery Augering System, Undated Advertising Brochure, Bulletin No. CA-103K, 2 pages.

1600B . . . Redesigned for the '90's, Undated Advertising Brochure, Bulletin No. CA-601-B, 2 pages.

The Salem MJ Mini-MUL-T Coal Recovery Auger, Undated Advertising Brochure, 2 pages.

The Salem S-1500-BK Coal Recovery Augering System, Undated Advertising Brochure, 2 pages.

Salem Augers Boost Recover Rates and Profit, Undated Brochure, 1 pages.

AUGER FLIGHT SUPPORT SYSTEM

CROSS-REFERENCE TO RELATED APPLICATIONS

This is a continuation of U.S. application Ser. No. 10/641,703, filed Aug. 15, 2003, now abandoned which was a continuation-in-part of U.S. application Ser. No. 10/074,412, filed Feb. 12, 2002, now U.S. Pat. No. 6,679,559, issued Jan. 20, 2004; the entire specifications of which are incorporated herein by reference.

BACKGROUND OF THE INVENTION

1. Technical Field

This invention generally relates to augering systems which remove coal from seams within a hill by boring long, horizontally extending holes into the coal seam using an auger comprising a rotary cutting head and a string of auger flights to convey the cut coal from the coal seam. More particularly, the invention relates to auger flight supports for reducing boring friction to extend the distance the auger system can bore into the hill. Specifically, the invention relates to an augering system that includes a support leg that lies between adjacent auger flights.

2. Background Information

Augering machines powered by internal combustion engines have been used for mining coal from hills containing a coal seam for many years. These augering machines utilize an auger having a cutting head which is advanced horizontally into the coal seam. The auger is usually made up of a series of sections or auger flights having a helical wound flighting, which removably couple together end-to-end to convey the cut coal from the cutting head to a point of discharge outside the hill. The auger flights are rotationally and axially coupled by having a socket at one end and a mating shank on the opposite end. The shank of one auger flight fits into the socket of the next auger flight. A slidable latch pin extends transversely through a hole in the auger flight and into a hole in the shank of the auger flight to be coupled thereto. A release lever permits uncoupling of the auger flights such as when the cutting head is being withdrawn from the bored hole at the completion of the boring. As the string of auger flights is withdrawn, the auger flights are sequentially removed from the auger string by uncoupling and lifting the rearmost auger flight from the auger machine. Pairs of side-by-side cutting heads and augers have been used recently to form a pair of parallel holes in the coal seam to remove a larger volume of coal at once. Each auger is powered by an auger machine which applies axial as well as rotational forces to the augers to force the augers and the cutting heads into the coal seam and to rotate the cutting heads breaking away the material which the augers then convey out of the hole.

There is considerable friction developed between the flighting of the auger flights and the bored holes which requires considerable power from the augering machines, and which reduces the power available to the cutting heads and to convey the cut coal. Attempts have been made to reduce such frictional power losses in auger systems. For example, in U.S. Pat. No. 3,036,821 issued to H. D. Letts, there is disclosed a spider device where bearings are attached between each of the linearly extending augers, and a plurality of legs are attached to the bearings to form a "spider". The spider somewhat supports the flighting on the bottom of the bored hole so that the flighting does not rub the ground as hard when rotating, thus reducing the power requirements of the auger machine. In U.S. Pat. No. 5,685,382 issued to Deeter, there is disclosed a similar auger support having a plurality of radially extending support legs affixed a bearing housing surrounding a bearing. The drive shank of an auger flight is rotatably supported by the bearing at one end of the auger flight, independently of the support provided by the auger flighting, to reduce wear and tear of the flighting and to reduce frictional drag of the auger flights. Finally, in U.S. Pat. No. Re 24,503 to C. E. Compton, which was originally U.S. Pat. No. 2,751,203, there is disclosed a spider-type support system for an auger mining system. All of these devices, however, fail to solve a number of problems associated therewith.

There is thus, a continuing need for a support device which overcomes a number of problems associated with the prior art.

SUMMARY OF THE INVENTION

One of the advantages of the present invention is that it provides reduced frictional losses between the flighting and the bottom of the bored holes resulting in less power required for boring a given length hole.

A further advantage of the present invention is that it permits longer holes to be bored using the same augering machine because of the reduced friction.

These and other advantages of the present invention may be realized by reference to the remaining portions of the specification, claims and abstract.

The present invention relates to an auger flight support for unitizing and supporting pairs of auger flights by connecting together respective first ends of each pair of parallel tubular auger flights. The auger flights each include a helical flighting affixed exteriorly therearound having a respective outer diameter, and include respective second ends having a drive socket. The unitized auger flights are adapted for use with an augering apparatus of the type used for rotating and advancing a pair of side-by-side cutting heads of a drilling section. The drilling section is driven horizontally into the side of a hill with the cutting heads driven rotationally through the drive sockets by the augering apparatus. The unitized auger flights are inserted between the drilling section and the augering apparatus in a rotationally coupled end-to-end manner as drilling progresses. Axially adjacent auger flights are connected end-to-end via bearing housings. A pair of drive shafts each includes a first end adapted to closely fit within and be fixable to the first end portion of a respective flight auger, a second end portion of mating configuration to the drive sockets, and a middle bearing portion which fits within said bearing housing. At least one bearing is disposed within each of the bearing housings between the respective bearing housing and the bearing portion of the respective drive shaft which bearing rotationally supports and longitudinally retains the respective drive shaft to the respective support post. The bearing housings of the side-by-side auger flights are connected to each other by way of a tie bar. A downwardly dependent leg extends from the tie bar in a position substantially equidistant from the side-by-side auger flights. The tie bar rigidly interconnects the bearing assemblies to each other so that the respective outer boring diameters of the flightings are closely adjacent one another. The support leg extends generally downwardly between the side-by-side auger flights so as to provide support for the auger flights and indirectly for the drilling heads.

The above description sets forth, rather broadly, features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purposes of description and should not be regarded as limiting.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

DETAILED DESCRIPTION OF THE INVENTION

Figure 1:
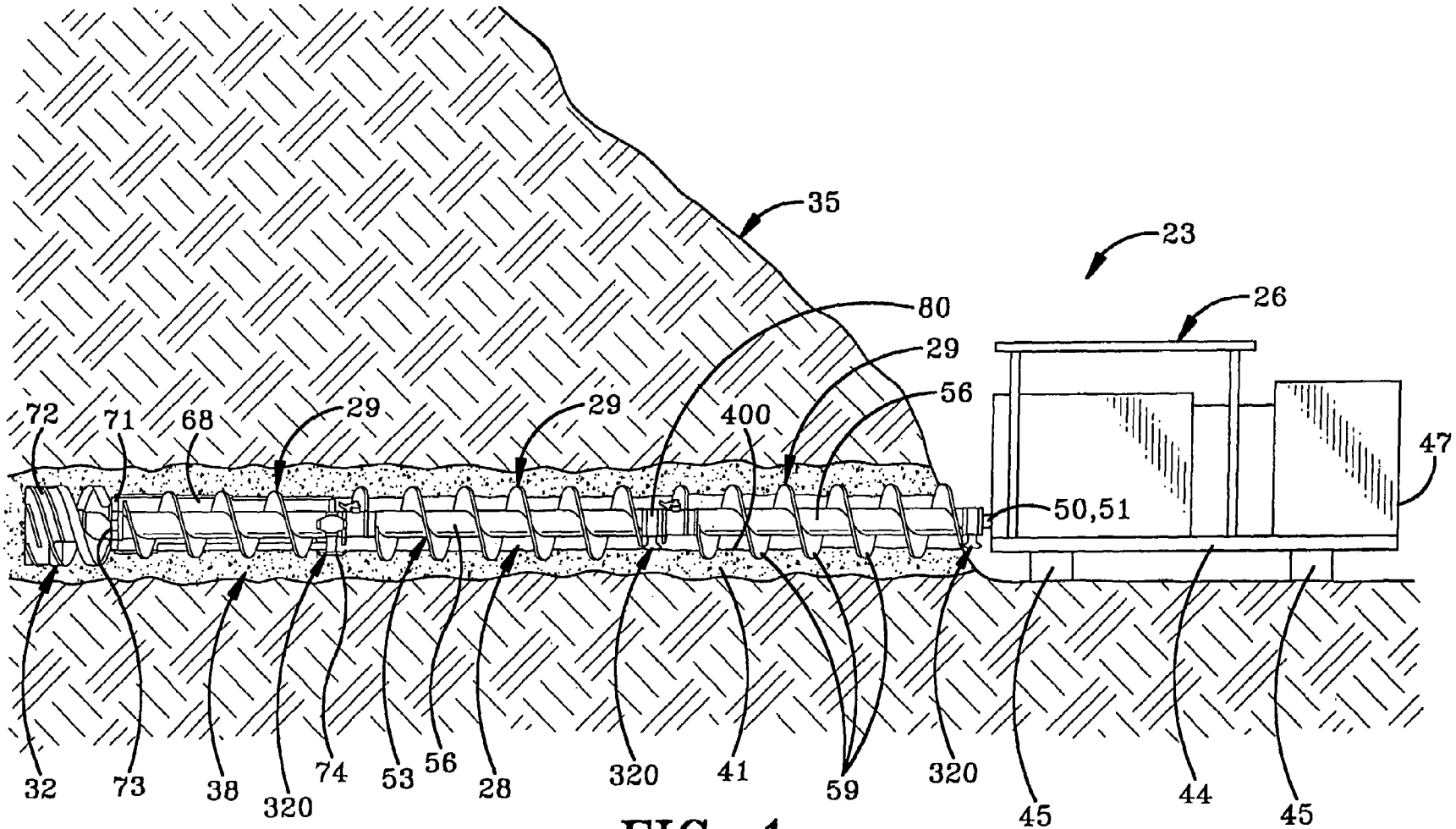
FIG. 1 is a vertical cross-sectional view of a hill showing an augering machine positioned adjacent the side of the hill and outside the hillside during drilling horizontally into a coal seam using an illustrative embodiment of auger flights and support assemblies according to the present invention.
Figure 3:
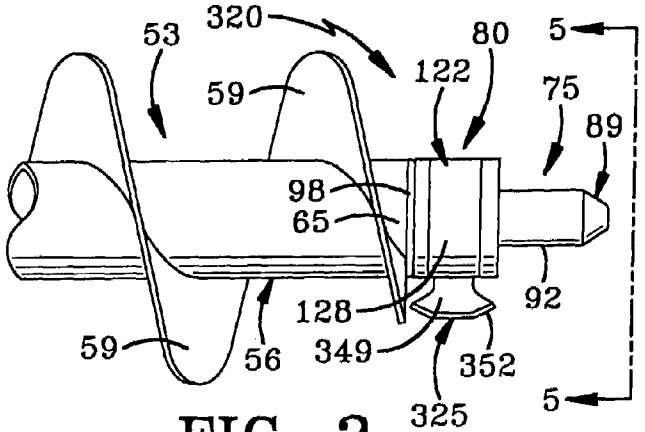
FIG. 3 is a fragmentary side elevational view corresponding to FIG. 2, but with the auger flight and the bearing housing assembled together.

Referring to FIG. 1, there is shown a plurality of auger flight supports 320 illustrative of the invention, as used with a conventional dual auger drilling system 23 which includes an augering machine 26 that drives a plurality of augers generally referred to by the number 28. Each auger 28 includes a plurality of unitized flight sections 29 and a unitized drilling section 32. Drilling system 23 is used for drilling into a hill 35 that contains a generally horizontally disposed coal seam 38 and to remove the resulting cut coal chunks 41.

Augering machine 26 is of conventional design for providing rotational power through flight sections 29 to drilling section 32. One such machine is the MC-DK Coal Recovery Auger, manufactured by the Salem Tool Company of London, Ky. Augering machine 26 includes a main frame 44 supported on a plurality of downwardly dependent legs 45. A wheeled carriage 47, which is hydraulically driven to force flight sections 29 and drilling section 32 into and out of the hill 35, travels longitudinally on main frame 44 on a pair of parallel rails (not shown) of main frame 44. An internal combustion engine (not shown) is mounted on carriage 47 and the engine drives flight sections 29 and drilling section 32 through a pair of power trains (not shown). The power trains (not shown) each include a clutch, a flexible coupling and a shiftable transmission. The power outputs through a pair of power outputs 50 and 51. Similarly, a triple system could be provided having an additional rotating auger disposed above the above-described pairs of augers 28.

Each unitized section 29 comprises a pair of auger flights 53 each having an elongate tubular body 56 to which is affixed a respective external helical flighting 59. Within a forward portion (not shown) of tubular body 56 there is affixed a socket insert (not shown) that has a drive socket (not shown) of a square cross-sectional configuration. The drive socket is adapted to slidably and non-rotatably fit a mating drive shank (not shown) on an axially adjacent auger flight 53, as is known in the industry. Therefore, adjacent pairs of axially aligned auger flights 53 may be rotationally interconnected and axially coupled to one another end-to-end by inserting the mating shank of one auger flight 53 to the mating socket of the axially aligned auger flight 53. This secures transmission of rotational torque and axial drilling force from one auger flight 53 to the other. Respective rearward portions 65 of tubular bodies 56 are held together in a spaced relationship by an auger flight support 320.

Drilling section 32 comprises a pair of auger flights 53 which are journaled to an elongate T-shaped center frame 68 at a front bearing support bracket 71 thereof. A pair of boring or drilling heads 72 each includes a square shank (not shown) which fits through a pair of thrust bearings 73 in support bracket 71. The square shanks fit into the drive socket (not shown) of tubular body 56 so as to be rotationally affixed to respective auger flights 53 of drilling section 32 to bore into coal seam 38. Therefore, adjacent axially aligned auger flights 53 of flight section 29 and drilling section 32 may be rotationally interconnected and axially coupled to one another to secure transmission of rotational torque and axial drilling force from one to the other. Respective portions 65 of tubular bodies 56 are held together in a spaced relationship by auger flight support 320 adjacent a plow plate 74 of the center frame 68, FIG. 1.

Referring to FIGS. 2–5, auger flight supports 320 comprise a pair of drive shafts 75, which each engage a bearing assembly 80. Drive shafts 75 include a first end portion 86 adapted to closely fit within and be affixable to rear portion 65 of a respective tubular body 56 at an annular weld 98. A second end portion 89 of drive shafts 75 includes a square drive shank 92 (FIG. 5) of mating configuration to the drive sockets. A middle bearing portion 95 is located between the respective first and second end portions 86 and 89. First end portion 86 includes an annular recess 101 for reducing the weight of the drive shaft 75.

Figure 2:
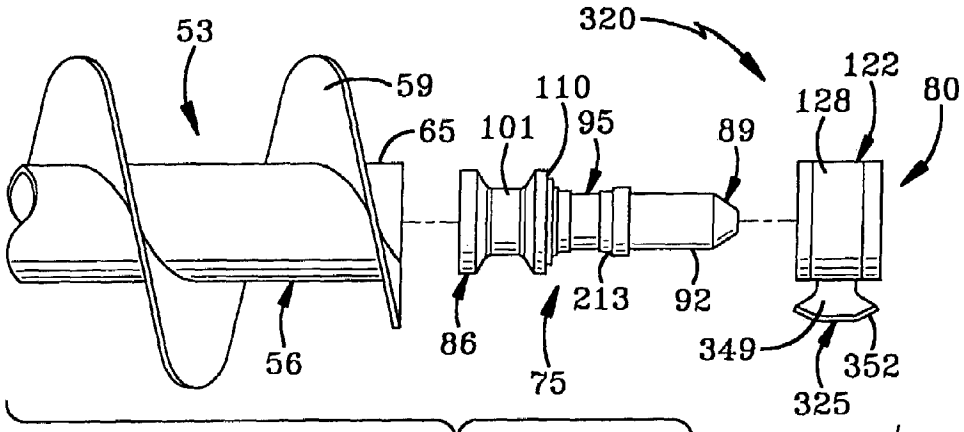
FIG. 2 is a fragmentary exploded side elevational view of an auger flight and a bearing housing.
Figure 4:
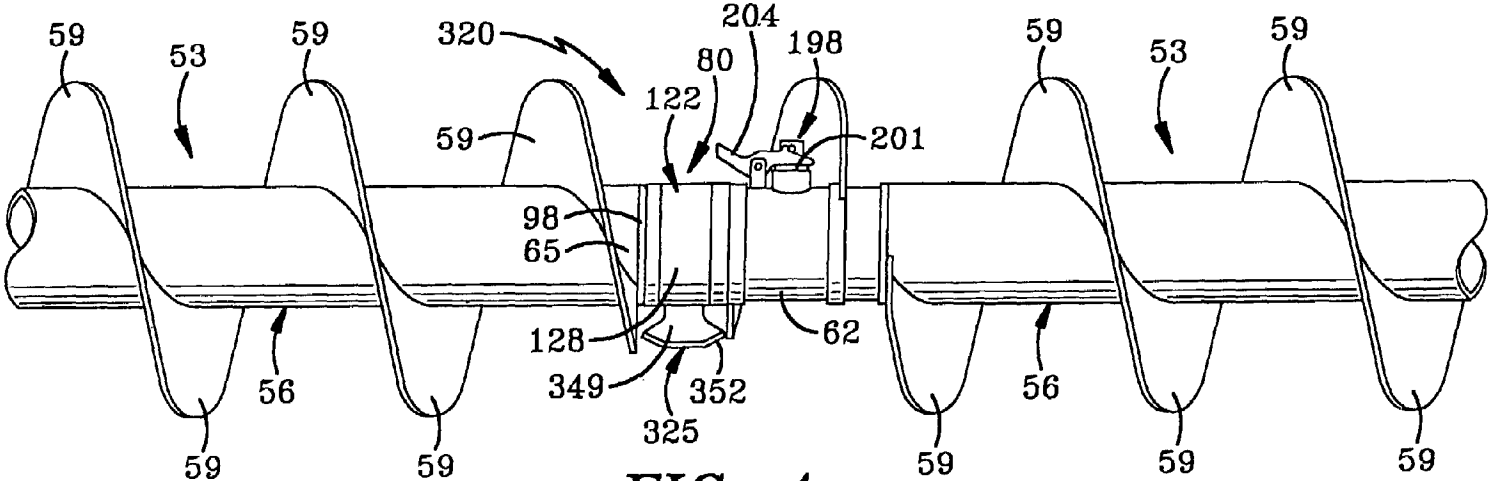
FIG. 4 is a fragmentary side elevational view of a pair of auger flights connected together by a tire bar.
Figure 5:
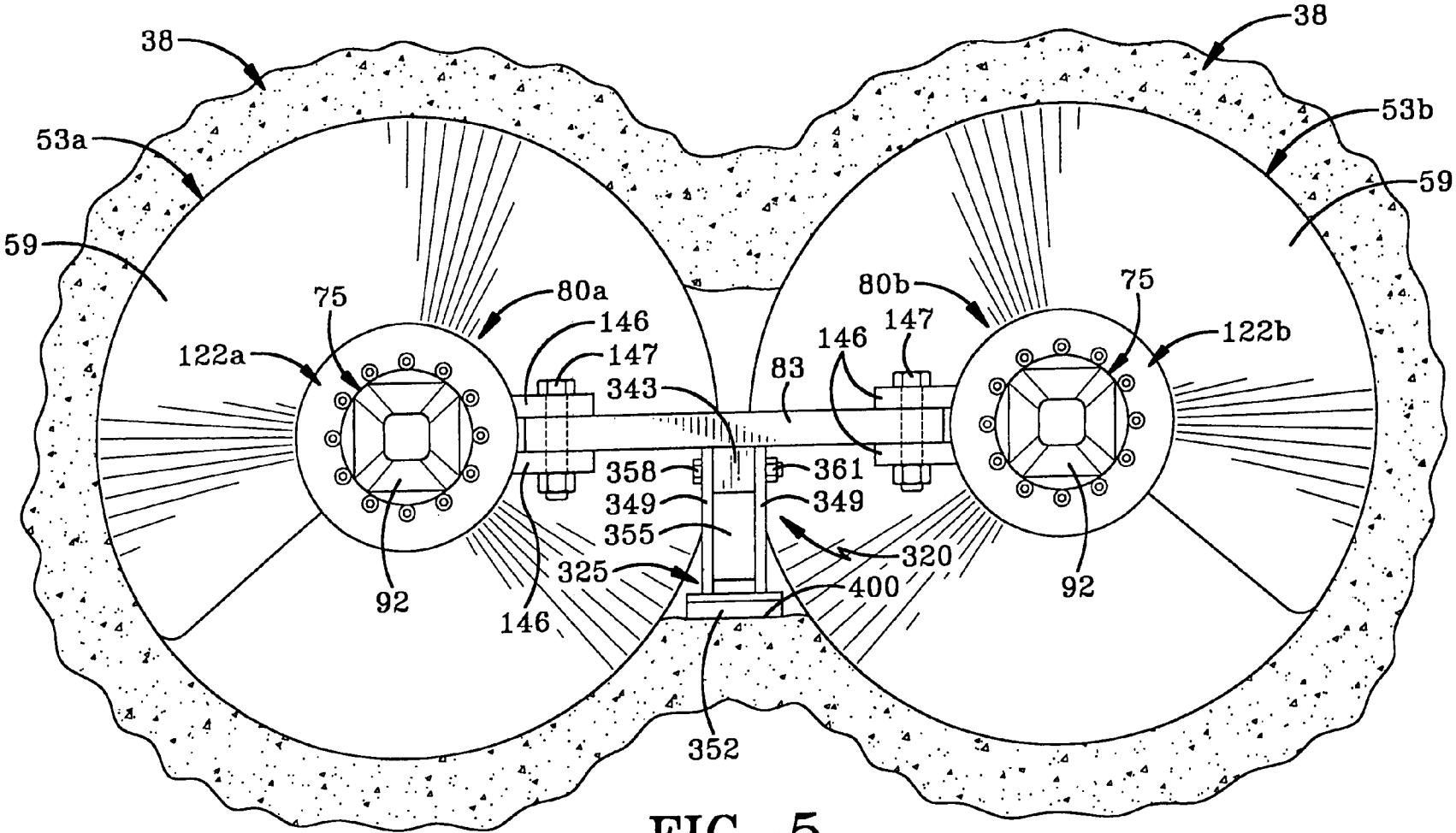
FIG. 5 is a front view of the invention showing a pair of auger flights, with a tie bar connecting side-by-side bearing housings together.
Figure 6:
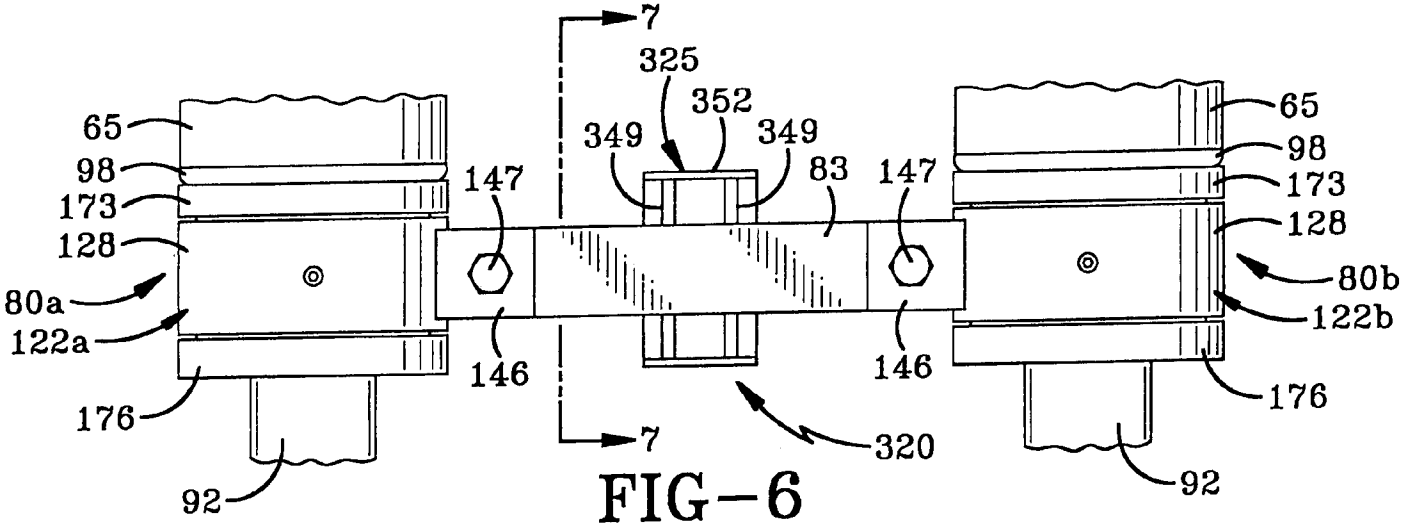
FIG. 6 is a fragmentary top view of the auger flights of FIG. 2, showing the tie bar connecting the bearing housings together.

Referring to FIGS. 5&6, bearing assemblies 80*a*, 80*b* each include a tubular bearing housing 122 having a tube 128 with a pair of laterally inwardly dependent tabs 146 extending therefrom. Bearing assemblies 80*a*, 80*b* each include an annular forward flange ring 173, and an annular rear flange ring 176. Flange ring 173 closely fits about the bearing support surface (not shown) of drive shaft 75 and includes an O-ring (not shown) disposed in an O-ring groove (not shown) which seals against the shoulder 110 (FIG. 2). Flange ring 176 closely fits about second end portion 89 at a shoulder (not shown) of drive shaft 75 and includes an O-ring (not shown) disposed in an O-ring groove (not shown) which seals against the shoulder.

Respective drive shafts 75 and bearing assemblies 80 are held together by a plurality of bolts (not shown) which extend through flange ring 176 and which longitudinally thread onto the shoulder of drive shaft 75. Alternatively, drive shaft 75 can be externally threaded at the shoulder and rear flange 176 is internally threaded so as to threadably engage to retain respective drive shafts 75 and bearing assemblies 80 together.

As seen in FIG. 2, respective auger flights 53 are axially coupled together using a locking pin assembly 198 as is known in the industry, which includes an inwardly biased, spring loaded pin 201 which engages lock pin hole 104 through drive shank 92, and a release lever 204 which is pivotally connected to forward portion 62 of auger flights 53. Depressing release lever 204 pulls pin 201 radially outwardly against the spring biasing to permit coupling and uncoupling of axially adjacent auger flights 53.

Figure 7:
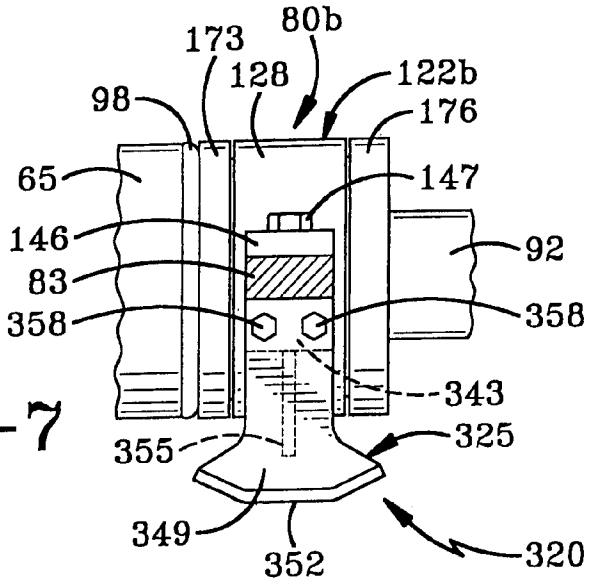
FIG. 7 is a side view taken on the line 7—7 of FIG. 6, showing the connection between the tie bar and the support leg.

Referring to FIGS. 5–7, bearing assemblies 80*a*, 80*b* are connected together using tie bar 83 which is connected to respective pairs of laterally dependent tabs 146 of bearing housings 122*a*, 122*b* by way of bolts 147. A leg mounting block 343 depends downwardly from tie bar 83 in a region located approximately at the center of tie bar 83 so that when tie bar 83 is connected to bearing assemblies 80*a*, 80*b*, leg 325 is disposed approximately midway between the bearing assemblies. A support leg 325 includes a pair of upright side plates 349 which extend vertically from an upwardly bent foot plate 352. The side plates 349 are interconnected by a front plate 355. Support leg 325 is connected to leg mounting block 343 using bolts 358 and locknuts 361. Flights 53*a* and 53*b* rotate in opposite directions. As auger flights 53 bore through coal seam 38, a small raised ledge 400 of coal/earth is left between the counter rotating augers 28. Support leg 325 engages the ledge 400 and rests thereon. A longitudinal frame member (not shown) which is disposed between auger flights 53 can be bolted between the axially adjacent tie bars 83 for additional support.

As can best be seen in FIG. 5, the length of support leg 325 is shorter than the diameter of auger flights 53*a*, 53*b*, inasmuch as support leg 325 is adapted to rest on ledge 400 between the parallel flights 53. Additionally, the foot plate 352 of support leg is of greater cross-sectional area than support leg 325 itself so as to provide a larger surface area for contacting ledge 400.

Operationally, it can be seen that support leg 325, when positioned on ledge 400, between adjacent auger flights 29, will support the weight of auger flights 29 and the material being transmitted rearwardly along the flights toward drilling machine 26. Additionally, support leg 325, by way of bearing assemblies 80*a*, 80*b*, will allow for the smooth rotation of the auger flights, substantially reducing drag and friction, allowing more energy to be transmitted to drilling head 72. Because the support leg 325 lies close to the center of gravity of the adjacent flight sections 29, the vibration in flight sections 29 is substantially reduced. A reduction in the vibration of flight sections 29 results in a reduction in the vibration of the drilling heads 72. This allows for an increased efficiency in the system, allowing the coal to be removed from coal seam 38 within hill 35 quicker and with less energy. Additionally, a significantly longer hole may be drilled into hill 35 along coal seam 38 allowing for more coal to be removed than was otherwise possible before the use of the present invention.

Additionally, in the inventor's co-pending application Ser. No. 10/074,412, a support post 77 is provided for each bearing assembly 80. As a consequence, each pair of bearing assemblies 80 has two support posts 77. In the embodiment disclosed herein, only one support leg 325 is provided for each pair of bearing assemblies 80*a*, 80*b*. This results in a substantial reduction in the cost of providing the presently disclosed support system over that disclosed in application Ser. No. 10/074,412.

While the above embodiment of the invention discloses that support leg 325 is removably attached to mounting block 343, leg 325 may alternatively be integrally formed with tie bar 83.

Additionally, this device could be used on an auger drilling system 23 which drives three unitized flight sections without departing from the spirit of the present invention.

It can now be seen that the present invention solves many of the problems associated with the prior art. The present invention provides reduced frictional losses between the flighting and the bottom of the bored holes resulting in less power required to bore a given length hole. The present invention also allows longer holes to be bored using the same augering machine due to the reduced friction. The present invention provides for dual auger boring.

Although the description above contains many specifications, these should not be construed as limiting the scope of the invention but as merely providing illustrations of some of the presently preferred embodiments of this invention. The specification, for instance, makes reference to dual auger boring, however, the present invention is not intended to be limited to use only with dual augers. Rather it is intended that the present invention can be easily adapted for use with three or more side-by-side augers by adding more pairs of tabs and additional tie bars, or even by adding augers which are vertically disposed. Thus, the scope of the invention should be determined by the appended claims and their legal equivalents rather than by the examples given.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An auger support assembly for connecting first ends of a first pair of parallel flighted augers to second ends of a second pair of parallel flighted augers, the support assembly comprising:

a pair of bearing housings; each bearing housing being directly connected to only the first end of one of the augers of the first pair;

a drive shaft extending outwardly from each first end of the first pair of augers, through the associated bearing housing and into engagement with one of the second ends of the second pair of augers;

a tie bar connecting the bearing housings to each other; and a single support leg extending downwardly away from the tie bar and being adapted to engage the ground beneath the tie bar, whereby the support leg holds the first and second ends of the respective first and second pairs of augers a spaced distance above the ground.

2. The auger support assembly as defined in claim 1, wherein the support leg is disposed at approximately midway along the length of the tie bar.

3. The auger flight support assembly as defined in claim 1, further comprising a mounting block extending outwardly away from the tie bar; and wherein the support leg is releasably secured to the mounting block.

4. The auger flight support assembly as defined in claim 1, further comprising a foot plate disposed at a ground-contacting end of the support leg; and wherein the foot plate is of a greater cross-sectional area than is the support leg.

5. The auger flight support assembly as defined in claim 1, wherein each of the flighted augers has a diameter and the support leg is shorter in length than the diameter of the augers.

6. The auger support assembly as defined in claim 1, further comprising a pair of locking pin assemblies, each locking pin assembly being connected to one of the second ends of the augers of the second pair and being disposed between the second ends and the bearing housings; the locking pin assemblies being engageable with the respective drive shafts to secure the augers of first and second pairs together.

7. The auger flight support assembly as defined in claim 1, wherein each drive shaft has a first end portion that is configured to closely fit within and be affixable to the first end of one of the augers of the first pair; a second end portion that is of mating configuration to a drive socket in the second end of one of the augers of the second pair, and a middle bearing portion which fits within the bearing housing.

8. The auger flight support assembly as defined in claim 7, wherein each of the drive shafts further includes an annular recess formed therein, the drive shaft having a first diameter and the annular recess having a second diameter, and wherein the second diameter is smaller than the first diameter.

9. The auger support assembly as defined in claim 1, further comprising at least one bearing disposed within each of the bearing housings; wherein the at least one bearing rotationally supports and longitudinally retains the respective drive shaft to the bearing housing.

10. A drilling system for drilling side-by-side holes; said system comprising:

a plurality of flighted augers, each auger having a first end and a second end, and having a helical flight extending between the first and second ends;

a drive shaft assembly connected to each of the first ends of the plurality of augers; whereby the drive shaft extends outwardly away from each of the first ends and is configured to be received within the second end of the immediately adjacent auger;

a plurality of auger support assemblies, each assembly comprising:

a tie bar;

a pair of bearing housings mounted on opposite ends of the tie bar; each bearing housing having a bore that is complementary sized to receive one of the drive shafts therethrough;

a single support leg extending downwardly away from the tie bar; the support being adapted to engage the ground beneath the tie bar; and wherein each drive shaft is received through one of the bores of one of the bearing housings and engages the second end of the immediately adjacent auger, whereby the augers are connected together in axially aligned pairs.

11. The drilling system as defined in claim 10, further comprising a plurality of locking pin assemblies, each locking pin assembly being secured to one of the second ends of one of the augers and being engageable with one of the drive shafts to lock the first end and second end of a pair of immediately adjacent augers together.

12. The drilling system as defined in claim 11, further comprising an augering machine operationally connected to a first rearward pair of the plurality of augers to provide rotational power thereto.

13. The drilling system as defined in claim 12, further including a pair of drilling heads, each drilling head being secured to one of the augers of a first front pair of the plurality of augers.

14. The drilling system as defined in claim 10, wherein the plurality of augers are connected together in axially aligned pairs; and wherein adjacent axially aligned auger pairs are separated from each other by a single pair of bushing housings, a single tie bar and a single support leg.

15. An auger flight support assembly for supporting a plurality of auger flights by connecting together respective first ends of parallel auger flights, the auger flights each having a respective helical flighting affixed exteriorly therearound and having a respective outer diameter and respective second ends having a drive socket, the auger flights being adapted for use with an auguring apparatus of the type used for rotating and advancing a plurality of side-by-side cutting heads of the drilling section, the drilling section which is driven horizontally into the side of the hill with the cutting heads driven rotationally through the drive sockets by the auguring apparatus, the unitized auger flights being inserted between the drilling section and the auguring apparatus in a rotationally coupled end-to-end manner as drilling progresses, the auger flight support assembly comprising:

a pair of bearing housings directly connected to only one of the first and second ends of the auger flights;

a pair of drive shafts, each having a first end portion adapted to closely fit within and be affixable to the first end of a respective auger, a second end portion of mating configuration to the drive sockets, and a middle bearing portion which fits within the bearing housing;

a tie bar interconnecting the pair of bearing housings at such a spacing that the respective of the outer boring diameters of the flightings are closely adjacent one another; and a single support leg extending downwardly from the tie bar; the leg being adapted to engage the surface of the ground lying beneath the tie bar and between the parallel auger flights.

16. The auger flight support assembly as defined in claim 15, further comprising a pair of locking pin assemblies, each locking pin assembly being connected to one of the second ends of the auger flights and being disposed between the second ends and the bearing housings; the locking pin assemblies being engageable with the respective drive shafts to secure the first and second ends of the augers together.

17. The auger support assembly as defined in claim 15, further comprising a mounting block disposed midway along the length of the tie bar and wherein the support leg is releasably secured to the mounting block.

18. The auger flight support assembly as defined in claim 15, further comprising a foot plate disposed at a ground-contacting end of the support leg; and wherein the foot plate is of a greater cross-sectional area than is the support leg.

19. The auger flight support assembly as defined in claim 15, wherein each of the flighted augers has a diameter and the support leg is shorter in length than the diameter of the augers.

20. The auger flight support assembly as defined in claim 15, wherein at least one bearing is disposed within each of the bearing housings between the respective bearing housing and the bearing portion of the respective the drive shaft, wherein the at least one bearing rotationally supports and longitudinally retains the respective drive shaft to the bearing housing.

* * * * *